US006536889B1

(12) United States Patent
Biegelsen et al.

(10) Patent No.: US 6,536,889 B1
(45) Date of Patent: Mar. 25, 2003

(54) SYSTEMS AND METHODS FOR EJECTING OR DEPOSITING SUBSTANCES CONTAINING MULTIPLE PHOTOINTIATORS

(75) Inventors: David K. Biegelsen, Portola Valley, CA (US); Richard N. Ellson, Palo Alto, CA (US); Michael Y. Young, Cupertino, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,907

(22) Filed: Oct. 31, 2001

(51) Int. Cl.[7] ..... B41J 2/17; B41J 2/01

(52) U.S. Cl. ..... 347/95; 347/103; 347/102; 347/100; 347/96

(58) Field of Search ..... 347/102, 100, 347/97, 95, 96, 101, 103

(56) References Cited

U.S. PATENT DOCUMENTS

| | | | | |
|---|---|---|---|---|
| 4,276,405 | A | | 6/1981 | Koleske et al. |
| 4,732,858 | A | | 3/1988 | Brewer et al. |
| 4,818,780 | A | | 4/1989 | Murray et al. |
| 4,822,718 | A | | 4/1989 | Latham et al. |
| 4,876,165 | A | | 10/1989 | Brewer et al. |
| 4,910,122 | A | | 3/1990 | Arnold et al. |
| 4,950,583 | A | | 8/1990 | Brewer et al. |
| 4,978,969 | A | | 12/1990 | Chieng |
| 5,024,922 | A | | 6/1991 | Moss et al. |
| 5,041,846 | A | | 8/1991 | Vincent et al. |
| 5,057,399 | A | | 10/1991 | Flaim et al. |
| 5,110,697 | A | | 5/1992 | Lamb, III et al. |
| 5,138,424 | A | | 8/1992 | Moss et al. |
| 5,234,990 | A | | 8/1993 | Flaim et al. |
| 5,262,195 | A | | 11/1993 | Moss et al. |
| 5,281,690 | A | | 1/1994 | Flaim et al. |
| 5,329,295 | A | | 7/1994 | Medin et al. |
| 5,336,925 | A | | 8/1994 | Moss et al. |
| 5,340,619 | A | | 8/1994 | Chen et al. |
| 5,362,608 | A | | 11/1994 | Flaim et al. |
| 5,368,989 | A | | 11/1994 | Flaim et al. |
| 5,401,613 | A | | 3/1995 | Brewer et al. |
| 5,406,321 | A | | 4/1995 | Schwiebert et al. |
| 5,428,384 | A | | 6/1995 | Richtsmeier et al. |
| 5,467,119 | A | | 11/1995 | Richtsmeier et al. |
| 5,479,199 | A | | 12/1995 | Moore et al. |
| 5,505,093 | A | | 4/1996 | Giedd et al. |
| 5,578,676 | A | | 11/1996 | Flaim et al. |
| 5,629,665 | A | | 5/1997 | Kaufmann et al. |
| 5,633,465 | A | | 5/1997 | Kaufmann et al. |
| 5,633,668 | A | | 5/1997 | Schwiebert et al. |
| 5,674,648 | A | | 10/1997 | Brewer et al. |
| 5,688,987 | A | | 11/1997 | Meador et al. |
| 5,693,691 | A | | 12/1997 | Flaim et al. |
| 5,753,523 | A | | 5/1998 | Giedd et al. |
| 5,780,201 | A | | 7/1998 | Sabnis et al. |
| 5,784,090 | A | | 7/1998 | Selensky et al. |
| 5,889,084 | A | * | 3/1999 | Roth ..... 523/161 |
| 5,892,096 | A | | 4/1999 | Meador et al. |
| 5,952,401 | A | | 9/1999 | Kimura et al. |
| 5,985,984 | A | | 11/1999 | Chatterjee et al. |
| 6,248,804 | B1 | * | 6/2001 | Lutz ..... 523/160 |
| 6,354,700 | B1 | * | 3/2002 | Roth ..... 347/103 |
| 6,426,034 | B1 | * | 7/2002 | McComas et al. ..... 428/500 |

* cited by examiner

*Primary Examiner*—Hai Pham
*Assistant Examiner*—Manish S. Shah
(74) *Attorney, Agent, or Firm*—Oliff & Berridge, PLC

(57) ABSTRACT

Method of ejecting or depositing a substance includes depositing at least one substance that includes first and second photoinitiators onto a substrate, causing the first photoinitiator to react by irradiating the substance with at least one light, and causing the second photoinitiator to react by irradiating the substance with at least one light. Substance ejecting or depositing system including a substrate, an applicator that deposits a substance that includes first and second photoinitiators onto a substrate, and at least one light usable to irradiate the substance to cause the first and/or second photoinitiators to react.

46 Claims, 6 Drawing Sheets

SYSTEMS AND METHODS FOR EJECTING OR DEPOSITING SUBSTANCES CONTAINING MULTIPLE PHOTOINTIATORS

BACKGROUND OF THE INVENTION

1. Field of the Invention

This invention is directed to systems and methods for ejecting or depositing substances containing multiple photoinitiators.

2. Description of Related Art

Direct marking print technologies are often limited by the time necessary to dry or cure the particular material that is being printed. For example, the ink drying inadequacies associated with ink jet-type printing have resulted in a limited number of applications for printing by this method. Printing by this method is seen most frequently in slow desktop printers. Once a water-based substance used in printing is applied to a substrate, such as paper, the ink remains wet until air dried or heat dried. In applications where double-side printing is required, or where printing is performed on non-absorbent substrates, the slow dry time is an obstacle to high print speeds. Slow dry time also limits speed and quality when printing with several different substances, or with the same substance on opposite sides of a substrate. For example, when different colored inks are deposited adjacent to each other, lateral bleed of the wet ink can reduce precision in graphics printing and other color printing applications. Similarly, second side relative registration is disturbed by wetness-induced media distortion.

A new printing technology exists that increases printing speed with fast, controllable drying ultraviolet photosensitive resin-containing substances. Fast drying substances containing ultraviolet photosensitive resins work well with direct marking print technology near room temperature.

The lithography industry is rapidly switching over to ultraviolet curable inks and pastes to take advantage of the fast drying nature of ultraviolet photosensitive inks on various substrates. However, the ultraviolet photosensitive substances used in lithography presses tend to have high tack or viscosity. Such formulations will not work with conventional ink jet technology. To use ultraviolet photosensitive inks in inkjet printing, an ink formulation having a low viscosity is required. Such formulations are known to those skilled in the art and can be manufactured using ultraviolet photosensitive resins typically used in the liquid crystal display industry.

With direct marking print technologies, such as ink jet applications, drop diameter spread control directly impacts the quality of print image resolution. To minimize lateral ink spread, the drop volume needs to be controlled and minimized, generally by using various ink delivery technologies. Properly selecting the target media substrate is also important. For example, cut-sheet paper tends to absorb water-based ink vertically and laterally, i.e., into and along the surface of the sheet. Furthermore, for printing on non-absorbing and semi-absorbing substrates, like transparencies, slow drying liquids, such as water based inks, will stay fluid and be held by surface tension until dried. These undried liquid puddles tend to smear if touched before they are completely dried.

SUMMARY OF THE INVENTION

In direct marking ejection or deposition methods, such as inkjet printing, the properties of the substances being ejected or ink being deposited are beneficially different at different stages of the process. For example, in the ejection head of a fluid ejection system, low viscosity is desirable, so that the fluid, such as ink, can be readily transported within the fluid distribution system and deposited onto a substrate. For a brief time after an ejected fluid droplet hits the substrate, a medium viscosity is desirable to allow intimate bonding of the fluid to the substrate, such as ink to the fibers of a sheet of paper, in a controlled fashion. However, quickly thereafter it is desirable that the fluid becomes rigid, to avoid lateral bleed. Curing substances containing ultraviolet photosensitive resins with conventional ultraviolet illumination, such as with a lamp or electron beam, makes it difficult to obtain and control the two separate phases of the substance that follow deposit on a substrate as described above.

Uncontrolled lateral spread of ejected fluids used in fluid ejection systems can be reduced and controlled by using fluids containing ultraviolet photosensitive resins. The quick-solidifying or "curing" nature of such fluids eliminates the problems of uncontrolled lateral spread and slow drying of ejected fluids. Due to the fast-curing nature of fluids containing these resins, such as ultraviolet photosensitive resin ink, this fluid ejecting method is extendible to ejecting fluids onto any substrate. Substrates can include paper, in direct marking processes, or intermediate transfer belts or rollers, in non-direct printing processes. Ultraviolet light intensity and exposure time duration can provide control over lateral spread, by permitting the partial curing of a fluid containing an ultraviolet photosensitive resin.

Curing fluids or other substances, such as inks, containing ultraviolet photosensitive resins, is often accomplished using an electron beam or an ultraviolet lamp. Such methods of curing an ultraviolet photosensitive resin are deficient, because, for example, the ultraviolet lamp emits broad ranges of frequencies and wavelengths of ultraviolet light, and are thus only suitable for curing ultraviolet photosensitive resins that react to broad ranges of wavelengths of ultraviolet light. Such methods are also limited in their applications, due to considerations of portability, power consumption, and ability to achieve a small form factor.

This invention provides methods and systems for ejecting or depositing substances containing multiple photoinitiators.

This invention separately provides methods and systems for ejecting or depositing substances containing multiple photoinitiators, and separately subjecting the substance to illumination with wavelengths of light specific to the constituent photoinitiators.

This invention separately provides methods and systems that permit selective irradiation of multiple substances that are sensitive to distinct wavelengths of ultraviolet light.

Fluid ejecting or depositing with substances comprising multiple ultraviolet photoinitiators allows discrete changes in fluid viscosity. Rapid changes to a pre-determined state can be caused by irradiating the substance with amounts of light in excess of a saturation dose specific to one of the constituent photoinitiators to cause that photoinitiators to completely react. With multiple photoinitiators and processes requiring only short range diffusion, multiple initiators using different wavelengths can be used to change properties of the substances in discrete steps. This eliminates problems of variability in continuous processes where parameters must be tightly controlled.

According to various exemplary embodiments of the systems and methods according to this invention, ejection or deposition is conducted using fluids, or other substances, containing multiple photoinitiators so that super-saturation doses of radiation of wavelengths corresponding to each photoinitiator rapidly change the fluid to pre-defined new states. Thus, a first light flash, or a first spatial zone through which the substance passes, causes the substance to take on a first state dictated by the first photoinitiator in response to exposure to light having a wavelength that the first photoinitiator in the substance is sensitive to. Subsequently, a second flash, or a second spatial zone, having a wavelength corresponding to a second photoinitiator causes the substance to take on a second state dictated by the second photoinitiator. For example, exposing an ink comprising a first photosensitive resin and a second photosensitive resin to light of a particular wavelength can cause the ink to become immediately viscous enough to take on a certain diffusivity. Exposing the ink to a second light of a different wavelength can cause the ink to become rigid and fixed. Any excess amount of light does nothing more to the ink, because performing each discrete step consumes all of the particular photoinitiator.

In various exemplary embodiments, in which different intermediate steps are desired, various changes can be chosen. Sub-saturation irradiation can be used to create a lower viscosity for ejecting or depositing on particular substrates. Similarly, by having several photoinitiators in a substance, successive illumination with light having successive wavelengths can tailor the time evolution of the states associated with the photoinitiators. By implementing intermediate wavelength pulses of light, intermediate states can be effected.

While manipulating viscosity in ejected or deposited fluid is a useful application of the methods and systems of this invention, properties other than viscosity can be modified in similar ways. The applications are limited only by the capabilities of the photoinitiators that are employed. For example, the color of a substance could be manipulated after deposit.

These and other features and advantages of this invention are described in, or are apparent from, the following detailed description of various exemplary embodiments of the systems and methods according to this invention.

BRIEF DESCRIPTION OF THE FIGURES

Various exemplary embodiments of this invention will be described in detail, with reference to the following figures, wherein.

DETAILED DESCRIPTION OF EXEMPLARY EMBODIMENTS

Figure 1:
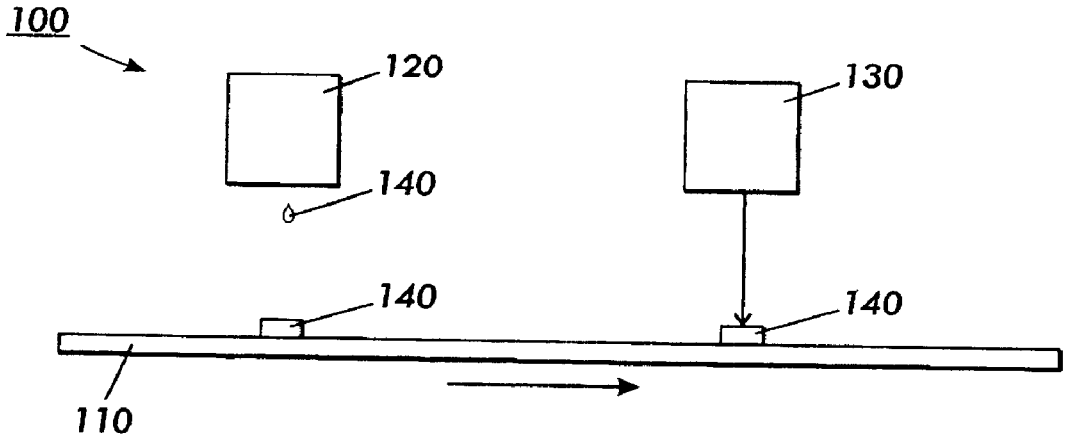
FIG. 1 is a schematic depiction of a first exemplary embodiment of a printing system according to the invention.

In various exemplary embodiments, the systems and methods according to this invention include depositing or ejecting at least one substance on a substrate. The at least one substance includes at least a first photoinitiator that reacts upon exposure to a first range of wavelengths of light and a second photoinitiator that reacts upon exposure to a second range of wavelengths of light that is distinct from the first range of wavelengths. Subsequently, the at least one substance is subsequently irradiated with an amount of light in the first range of wavelengths effective to cause the first photoinitiator to react, and then irradiating the at least one substance with an amount of light in the second range of wavelengths effective to cause the second photoinitiator to react.

In various exemplary embodiments of the systems and methods according to this invention, irradiating the at least one substance with an amount of light in the first range of wavelengths includes irradiating the at least one substance with an amount of light in the first range that is effective to cause substantially all of the first photoinitiator to react. Similarly, irradiating the at least one substance with an amount of light in the second range of wavelengths includes irradiating the at least one substance with an amount of light in the second range effective to cause substantially all of the second photoinitiator to react. By completely reacting the first and second photoinitiators, less control is required over various process parameters, such as the exposure time and the intensity of the light used to irradiate the at least one substance. Irradiating the at least one substance with saturating doses of illumination uses the photoinitiators to create a binary response in the substance. That is, the photoinitiator is either unreacted or completely reacted. However, if intermediate states are desired, a non-saturating dose can be used.

Applications of the systems and methods of ejecting or depositing with substances having multiple photoinitiators is limited only by the photoinitiators that are employed. Photoinitiators can be used to effect a variety of changes in a deposited substance. For example, the viscosity of the substance can be altered to dry or cure the substance. Alternatively, the color of the substance, or the electrical conductivity of the substance can be altered after deposit.

In various exemplary embodiments of the systems and methods according to this invention, the substance which is deposited can include first and second photoinitiators that are ultraviolet photosensitive resins. In these and other embodiments, irradiating the at least one substance with an amount of light in the first range of wavelengths achieves a first viscosity in the substance. Irradiating the at least one substance can include irradiating with an amount of light in the second range of wavelengths to achieve a second viscosity in the substance. When viscosity-altering photoinitiators, such as ultraviolet photosensitive resins, are used, a range of viscosities can be achieved depending on the amount of photoinitiator that is reacted, which in turn depends on the duration and intensity of the applied illumination. In various exemplary embodiments, where saturating doses of illumination are employed, the effect is to have three discrete states of the substance: the pre-illumination viscosity, a viscosity that is achieved when all of the first photoinitiator is reacted, and a viscosity that is achieved when all of the second photoinitiator is reacted.

In various exemplary embodiments of the systems and methods according to this invention, the at least one ejected or deposited substance can be at least one type or color of ink and the substrate can be paper. In such embodiments, the first viscosity can be a viscosity effective to permit the at least one ink to permeate the paper and the second viscosity can be a viscosity effective to substantially prevent lateral bleeding of the at least one ink.

In various exemplary embodiments, the substance is partially cured with at least one ultraviolet light emitting device. The substance can be partially cured using an ultraviolet laser, or an ultraviolet light emitting diode, or an ultraviolet lamp. The at least one ultraviolet light emitting device can include a lamp, a stationary flood laser, a scanning laser beam, a single light-emitting diode or an array of light-emitting devices. The at least one ultraviolet light emitting device can be capable of separately emitting different wavelengths of light. An exemplary array of ultraviolet light emitting devices is an array of $Al_xGa_{1-x}N$ light emitting diodes, where x is the fractional composition of the alloy. For each value of x, a particular narrow range of wavelengths is emitted.

In various exemplary embodiments, depositing or ejecting at least one substance includes depositing or ejecting a plurality of substances, each comprising first and second photosensitive resins that polymerize upon exposure to ranges of wavelengths of light specific to each substance. In various exemplary embodiments, the ranges of wavelengths at which the photoinitiators of each of the plurality of substances react are distinct from the ranges of wavelengths at which the photoinitiators of the other substances react. Irradiating the plurality of substances can include irradiating the plurality of substances with an amount of light in one or more of the first ranges of wavelengths to achieve a first viscosity in one or more of the plurality of substances. In various exemplary embodiments, irradiating the at least one substance includes irradiating one or more of the plurality of substances with an amount of light in one or more of the second ranges of wavelengths to achieve a second viscosity in one or more of the plurality of substances.

In various exemplary embodiments, where depositing or ejecting at least one substance includes depositing or ejecting a plurality of substances, the steps of depositing each of the plurality of substances and irradiating each of the plurality of substances can be interleaved with each other. Accordingly, a first substance from the plurality of substances can be deposited onto the substrate, and subsequently irradiated with light in the respective first and second ranges of wavelengths of light, and a second substance from the plurality of substances can be deposited onto the substrate at any point from prior to deposit of the first substance to after irradiation of the first substance with the respective second range of wavelengths of light. For example, a first substance from the plurality of substances can be deposited onto the substrate, and subsequently irradiated with light in the respective first and/or second ranges of wavelengths of light, prior to depositing a second substance from the plurality of substances onto the substrate.

In various exemplary embodiments, depositing or ejecting a plurality of substances can include depositing or ejecting the first substance, a second substance, a third substance and a fourth substance on the substrate. The first substance includes a first photoinitiator and a second photointiator that react upon exposure to first and second ranges of wavelengths. The second substance includes third and fourth photoinitiators that react upon exposure to third and fourth ranges of wavelengths. The third substance includes fifth and sixth photoinitiators that react upon exposure to fifth and sixth ranges of wavelengths. The fourth substance includes seventh and eighth photoinitiators that react upon exposure to seventh and eighth ranges of wavelengths.

Irradiating the first, second, third and fourth substances can include irradiating each of the first, second, third and fourth substances with light from the first, third, fifth and seventh ranges of wavelengths. The first substance can be irradiated with an amount of light, having a wavelength within the first range of wavelengths, that is effective to achieve a first viscosity in the first substance. The second substance can be irradiated with an amount of light, having a wavelength within the third range of wavelengths, that is effective to achieve a third viscosity in the second substance. The third substance can be irradiated with an amount of light, having a wavelength within the fifth range of wavelengths, that is effective to achieve a fifth viscosity in the third substance. The fourth substance can be irradiated with an amount of light, having a wavelength within the seventh range of wavelengths, that is effective to achieve a seventh viscosity in the fourth substance.

Irradiating the first, second, third and fourth substances further includes irradiating the first, second, third and fourth substances with light from second, fourth, sixth and eighth wavelengths. The first substance can be irradiated with an amount of light, having a wavelength within the second range of wavelengths, that is effective to achieve the second viscosity in the first substance. The second substance can be irradiated with an amount of light, having a wavelength within the fourth range of wavelengths, that is effective to achieve the fourth viscosity in the second substance. The third substance can be irradiated with an amount of light, having a wavelength within the sixth range of wavelengths, that is effective to achieve a sixth viscosity in the third substance. The fourth substance can be irradiated with an amount of light, having a wavelength within the eighth range of wavelengths, that is effective to achieve an eighth viscosity in the fourth substance.

In various exemplary embodiments, where four substances are deposited on the substrate, the first, second, third and fourth substances can be cyan, magenta, yellow and black inks. In other exemplary embodiments where four substances are deposited on the substrate, the first, second, third and fourth substances can be red, green, blue and black inks.

The systems and methods according to this invention achieve selective chemical reactions within substances, such as inks, comprising, for example, ultraviolet photosensitive resins, to achieve different humanly visible process colors, for example, in the cyan-magenta-yellow-black system or the red-green-blue-black system useful in printing on transparent materials. Curing such colored substances, having different photo-initiators, renders each differently colored substance photosensitive to a different range of wavelengths of light. As such, a light source is provided, which can generate various wavelength ranges of light, allowing selective curing and providing a wide range of control for the individual process colors.

In various exemplary embodiments, the systems and methods of this invention can also include transferring the at least one substance from the substrate to a second substrate after irradiating the at least one substance with an amount of light in the first ranges of wavelengths, and before irradiating the at least one substance with an amount of light in the second ranges of wavelengths.

In various exemplary embodiments of the systems and methods according to this invention, transferring the substance from the first substrate to the second substrate includes transferring the substance from an intermediate transfer belt or drum to a sheet of paper. In various exemplary printing embodiments, using an intermediate transfer belt or drum with photosensitive substances helps control both the lateral spread of the substance on the belt or drum as well as separately controlling the subsequent ink penetration of the substance into the paper substrate. This is accomplished by partially curing the substance on the intermediate transfer belt or drum by exposing the substance to light. Pile height is also controlled as the substance on the intermediate transfer belt or drum is transferred to paper.

Transferring the substance from the first substrate can include transferring the substance from a blackened intermediate transfer belt or drum. A blackened intermediate transfer belt or drum addresses the problem of ultraviolet light reflection on the first substrate. In various exemplary embodiments, the belt or drum surface is blackened to minimize stray light exposure pixel crosstalk effects.

In various exemplary embodiments, the systems and methods of this invention include depositing or ejecting at least one substance onto a substrate. The substrate includes a first photoinitiator that reacts upon exposure to a first range of wavelengths of light. In this case, the substance combines with the first photoinitiator as the substance is deposited. Subsequently, the at least one substance is irradiated with an amount of light in the first range of wavelengths that is effective to react substantially all of the first photoinitiator. In various exemplary embodiments, the substrate further includes a second photoinitiator that reacts upon exposure to a second range of wavelengths of light that is distinct from the first range of wavelengths. The substance also combines with the second photoinitiator as the substance is deposited. In such embodiments, the systems and methods of this invention can also include irradiating the at least one substance with an amount of light in the second range of wavelengths that is effective to react substantially all of the second photoinitiator.

In various exemplary embodiments of the systems and methods according to this invention that include transferring the substance from the substrate to a second substrate, the substrate and/or the second substrate can include at least one photoinitiator, as described above. Accordingly, the substance can be combined with a photointiator when the substance is deposited on the substrate and/or when the substance is transferred to the second substrate.

In various exemplary embodiments, where the substrate includes a first photoinitiator, the substance can include a second photoinitiator that reacts upon exposure to a second range of wavelengths of light that is distinct from the first range of wavelengths. Various exemplary embodiments of the systems and methods according to this invention further include irradiating the at least one substance with an amount of light in the second range of wavelengths that is effective to react substantially all of the second photoinitiator.

The systems and methods of this invention are further directed to any known or later-developed substance ejecting or depositing systems that are capable of performing a two-phase curing of substances comprising at least two photoinitiators.

FIG. 1 illustrates a first exemplary embodiment of a substance ejecting or depositing system 100 and related method according to this invention. The substance ejecting or depositing system 100 includes a substrate 110, an applicator 120 and a light subsystem 130. The applicator 120 is usable to deposit at least one substance 140 on the substrate 110. The at least one substance 140 can include at least a first photoinitiator that reacts upon exposure to a first range of wavelengths of light and a second photoinitiator that reacts upon exposure to a second range of wavelengths of light that is distinct from the first range of wavelengths. The light subsystem 130 can be usable to separately irradiate the at least one substance 140 with light that is within the ranges of wavelengths specific to each of the first and second photoinitiators.

The light subsystem 130 can include any known or later-developed light emitting device that is capable of emitting light. The light subsystem 130 can include one or more separate light sources or light emitting devices, at least one array of light sources or light emitting devices, or any combination of one or more separate light sources or light emitting devices and one or more arrays. The light subsystem 130 can also include any known or later developed device or fixture associated with the one or more lights or light emitting devices that provides power, or manipulates intensity, direction, wavelength, or any other parameters of the light emitted by the one or more lights or light emitting devices.

In various exemplary embodiments of the substance ejecting or depositing systems, the substrate can be paper and the at least one substance can be at least one ink. In various exemplary embodiments, the substance ejecting or depositing systems can include an applicator 120 that is usable to deposit at least one ink, where the at least one ink includes at least one ultraviolet photosensitive resin as a photoinitiator. The applicator 120 can be an ink jetting system, a transfer roller, or any other means of depositing the substance 140 onto the substrate 110.

During operation of the substance ejecting or depositing system 100, the applicator 120 deposits the at least one substance 140 that includes the first and second photoinitiators onto the substrate 110. After the at least one substance 140 has been deposited on the substrate 110, the light subsystem 130 separately causes the first and second photoinitiators in the at least one substance 140 to react by irradiating the at least one substance 140 with light.

The light subsystem 130 causes the first photoinitiator in the at least one substance 140 to react by irradiating the at least one substance with light having a wavelength within the range of wavelengths to which the first photoinitiator reacts, with an amount of light effective to achieve a desired property in the at least one substance. The light subsystem 130 subsequently causes the second photoinitiator in the at least one substance 140 to react by irradiating the at least one substance with light having a wavelength within the range of wavelengths to which the second photoinitiator reacts, with an amount of light effective to achieve a second desired property in the substance.

Figure 2:
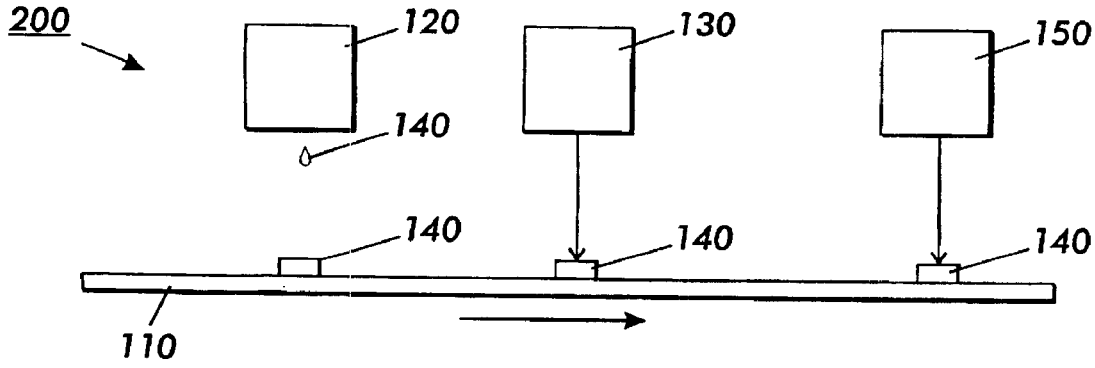
FIG. 2 is a schematic depiction of a second exemplary embodiment of a printing system according to the invention.

FIG. 2 illustrates a second exemplary embodiment of a substance ejecting or depositing system 200 and related methods according to this invention. The second substance ejecting or depositing system 200 includes elements 110–140 of the first substance ejecting or depositing system 100. Thus, these elements will not be described again. The second substance ejecting or depositing system 200 further includes a second light subsystem 150, positioned to be usable to irradiate the at least one substance 140 that has been deposited on the substrate 110. The second light subsystem 150 can be implemented using any of the structures described with respect to the first light subsystem 130. Thus, further description of the second light subsystem 150 is omitted. After the light subsystem 130 causes the first photoinitiator in the at least one substance 140 that has been deposited on the substrate 110 to react, the second light subsystem 150 further irradiates the at least one substance 140 with light having a wavelength within the range of wavelengths to which the second photoinitiator reacts. As shown in FIG. 2, in the second ejecting or depositing system 200, the second light subsystem 150 is spaced apart form the first light subsystem 130. If the substrate is translating laterally relative to the subsystems 120, 130 and 150, then the spacing between subsystems 130 and 150 permits temporal delay between reactions of the first and second photoinitiators. It should be appreciated that multiple systems 200 can be used sequentially to serially deposit and cure substances.

Figure 3:
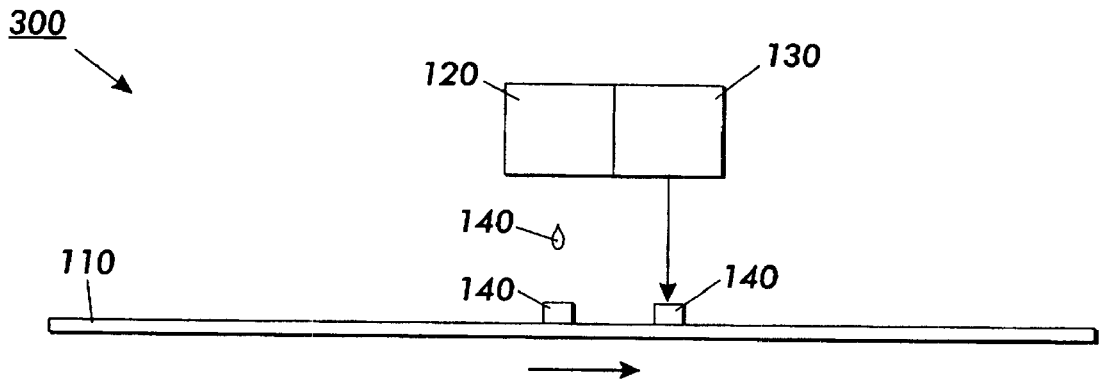
FIG. 3 is a schematic depiction of a third exemplary embodiment of a printing system according to the invention.

FIG. 3 illustrates a third exemplary embodiment of a substance ejecting or depositing system 300 and related methods according to this invention, in which the light subsystem 130 is integrated with the applicator 120. The third ejecting or depositing system 300 includes elements 110–140 of the first substance ejecting or depositing system 100. Thus, these elements will not be described again. During operation of the third substance ejecting or depositing system 300, the applicator 120 deposits the at least one substance 140 that includes the first photoinitiator and the second photoinitiator onto the substrate 110, in the same manner as the first substance ejecting or depositing system 100 of FIG. 1. After the at least one substance 140 has been deposited on the substrate 110, the light subsystem 130 separately causes the first and second photoinitiators in the at least one substance 140 to react by irradiating the at least one substance 140 with light. However in the substance ejecting or depositing system 300, the light subsystem 130 is physically attached to the applicator 120.

Figure 4:
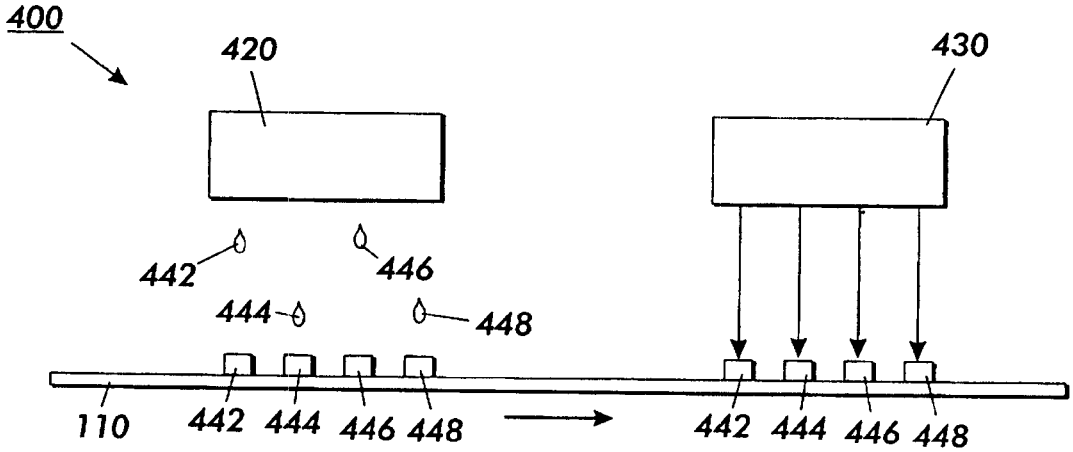
FIG. 4 is a schematic depiction of a fourth exemplary embodiment of a printing system according to the invention.

FIG. 4 illustrates a fourth exemplary embodiment of a substance ejecting or depositing system 400 and related methods according to this invention. The various elements of the fourth ejecting or depositing system 400 are generally similar to the corresponding elements of the first, second and third ejecting or depositing systems 100–300. However, in contrast to the first, second and third ejecting or depositing systems 100–300, in the fourth ejecting or depositing system 400, the applicator 120 is replaced with an applicator 420. The applicator 420 is usable to separately deposit a plurality of substances 442, 444, 446 and 448 on the substrate 110. Each of the plurality of substances 442, 444, 446 and 448 includes at least a first photoinitiator that reacts upon exposure to a first range of wavelengths of light and a second photoinitiator that reacts upon exposure to a second range of wavelengths of light that is distinct from the first range of wavelengths. It should be appreciated that the first wavelengths at which the photoinitiators in each of the plurality of substances 442, 444, 446 and 448 react can each be different from the others, or some can be different from the others. Likewise, the second wavelengths at which the photoinitiators in each of the plurality of substances 442, 444, 446 and 448 react can each be different from the others, or some can be different from the others.

In such exemplary embodiments, the substance ejecting or depositing system 400 includes a light subsystem 430 in place of the light subsystem 130. The light subsystem 430 is usable to separately irradiate each of the plurality of substances 442, 444, 446 and 448 with the particular first and second ranges of wavelengths of light specific that are appropriate for each of the plurality of substances 442, 444, 446 and 448.

In operation of the fourth substance ejecting or depositing system 400, the applicator 420 deposits a plurality of substances on the substrate 10. The plurality substances 442, 444, 446 and 448 can include, for example, a first substance, a second substance, a third substance and a fourth substance each having a first and second photoinitiators. After one or more of the plurality of substances 442, 444, 446 and 448 have been deposited on the substrate 110, the light subsystem 430 separately causes the first and second photoinitiators in each of the plurality of substances 442, 444, 446 and 448 that have been deposited to react by irradiating the plurality of substances 442, 444, 446 and 448 with light.

The light subsystem 430 causes the first photoinitiator in at least one of the plurality of substances 442, 444, 446 and 448 to react by irradiating the plurality of substances 442, 444, 446 and 448 with light having a wavelength within the range of wavelengths to which the first photoinitiator reacts, and with an amount of light effective to achieve a desired property in one or more of the substances 442, 444, 446 and 448. The light subsystem 430 subsequently causes the second photoinitiator in at least one of the plurality of substances 442, 444, 446 and 448 to react by irradiating the at least one substance with light having a wavelength within the range of wavelengths to which the second photoinitiator reacts, and with an amount of light effective to achieve a second desired property in one or more of the substances 442, 444, 446 and 448.

In various exemplary embodiments of the fourth substance ejecting or depositing system 400, the first light subsystem 430 can be integrated with the applicator.

Figure 5:
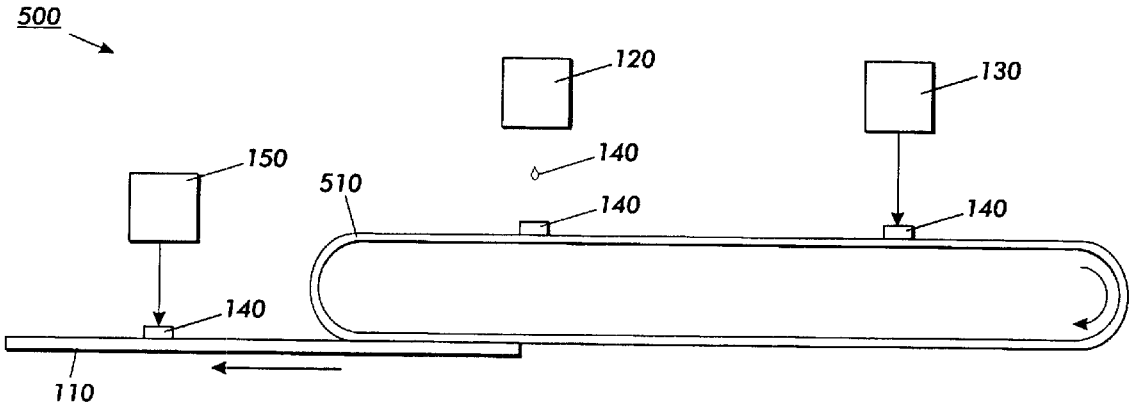
FIG. 5 is a schematic depiction of a fifth exemplary embodiment of a printing system according to the invention.

FIG. 5 illustrates a fifth exemplary embodiment of a substance ejecting or depositing system 500 and related methods according to this invention. The fifth substance ejecting or depositing system 500 includes an intermediate substrate 510, the applicator 120, the first light subsystem 130, and the second light subsystem The substance ejecting or depositing system 500 can used to deposit at least one substance 140 on the first substrate 510. The at least one substance 140 includes at least a first photoinitiator that reacts upon exposure to a first range of wavelengths of light and a second photoinitiator that reacts upon exposure to a second range of wavelengths of light that is distinct from the first range of wavelengths. The first light subsystem 130 can be positioned relative to the intermediate substrate 510 to irradiate the at least one substance 140 to completely react the first photoinitiator. The intermediate substrate 510 can be positioned to be usable to transfer the at least one substance 140 from the intermediate substrate 510 to the substrate 110. The second light subsystem 150 can be positioned to be usable to irradiate the at least one substance 140 after the at least one substance has been transferred from the intermediate substrate 510 to the substrate 110.

In operation of the fifth substance ejecting or depositing system 500, the applicator 120 deposits the at least one substance 140 onto the intermediate substrate 510. After the at least one substance 140 has been deposited on the intermediate substrate 510, the light subsystem 130 causes the first photoinitiator in the at least one substance 140 to react by irradiating the at least one substance 140 with light.

The light subsystem 130 causes the first photoinitiator in the at least one substance 140 to react by irradiating the at least one substance 140 with light having a wavelength within the range of wavelengths to which the first photoinitiator reacts, and with an amount of light effective to achieve a desired property in the substance 140. After the at least one substance 140 has been irradiated by the light subsystem 130 on the intermediate substrate 510, the at least one substance 140 is transferred from the intermediate substrate 510 to the substrate 110.

Once the at least one substance 140 has been transferred to the substrate 110, the second light subsystem 150 causes the second photoinitiator in the at least one substance 140 to react by irradiating the at least one substance 140 with light having a wavelength within the range of wavelengths to which the second photoinitiator reacts, with an amount of light effective to achieve a second desired property in the substance 140.

Figure 6:
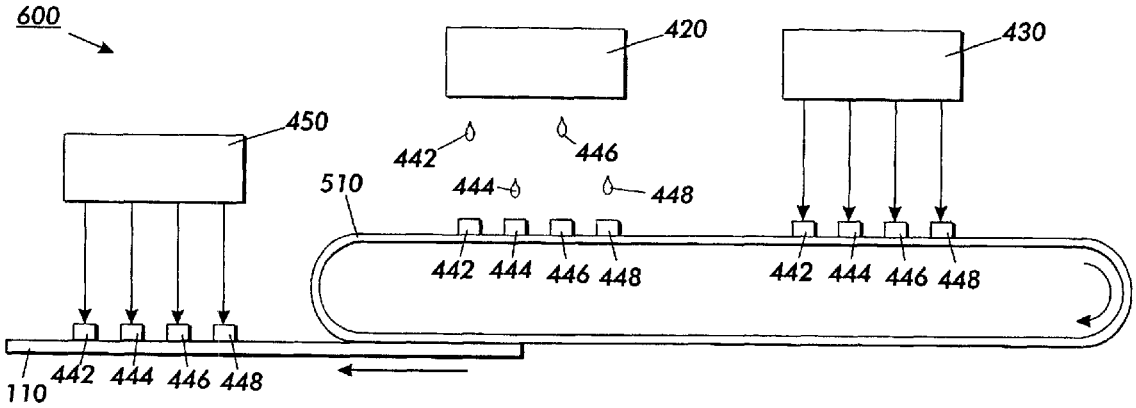
FIG. 6 is a schematic depiction of a sixth exemplary embodiment of a printing system according to the invention.

FIG. 6 illustrates a sixth exemplary embodiment of a substance ejecting or depositing system 600 and related methods according to this invention. As shown in FIG. 6, in the sixth substance ejecting or depositing system 600, the applicator 120 and the light subsystem 130 of the fifth substance ejecting or depositing system 500 are replaced with the applicator 420 and the light subsystem 430 of the fourth substance ejecting or depositing system 400. The sixth substance ejecting or depositing system 600 further includes a second light subsystem 450, positioned to be usable to irradiate the plurality of substances 442, 444, 446, 448 that have been transferred to the intermediate substrate 510. The second light subsystem 450 can be implemented using any of the structures described with respect to the first light subsystem 430. Thus, further description of the second light subsystem 450 is omitted.

The applicator 420 can be used to separately deposit a plurality of substances 442, 444, 446 and 448 on the intermediate substrate 510, as described above. Each of the plurality of substances 442, 444, 446 and 448 can include at least a first photoinitiator that reacts upon exposure to a first range of wavelengths of light and a second photoinitiator that reacts upon exposure to a second range of wavelengths of light that is distinct from the first range of wavelengths. It should, again, be appreciated that the first wavelengths at which the photoinitiators in each of the plurality of substances 442, 444, 446 and 448 react can each be different from the others, or some can be different from the others. Likewise, the second wavelengths at which the photoinitiators in each of the plurality of substances 442, 444, 446 and 448 react can each be different from the others, or some can be different from the others. In such embodiments, the sixth substance ejecting or depositing system 600 also includes the first light subsystem 430 that is usable to separately irradiate each of the plurality of substances 442, 444, 446 and 448 with light that is within one or more of the particular first and second ranges of wavelengths of light that are appropriate for each of the plurality of substances 442, 444, 446 and 448.

In various exemplary embodiments of the sixth substance ejecting or depositing system 600, the first light subsystem 430 can be mounted on the applicator.

In operation of the sixth substance ejecting or depositing system 600, the applicator 420 deposits a plurality of substances on the intermediate substrate 510. The plurality of substances 442, 444, 446 and 448 can include, for example, a first substance, a second substance, a third substance and a fourth substance each including a first and second photoinitiator. After the plurality of substances 442, 444, 446 and 448 have been deposited on the intermediate substrate 510, the light subsystem 430 causes the first photoinitiator of at least one of the plurality of substances 442, 444, 446 and 448 to react by irradiating at least one of the substances 442, 444, 446 and 448 with light.

The light subsystem 430 causes the first photoinitiator in at least one of the plurality of substances 442, 444, 446 and 448 to react by irradiating the plurality of substances 442, 444, 446 and 448 with light having a wavelength within the range of wavelengths to which the first photoinitiator reacts, and with an amount of light effective to achieve a desired property in that one or more substance 442, 444, 446 and 448. After the plurality of substances 442, 444, 446 and 448 have been irradiated by the light subsystem 430 on the intermediate substrate 510, the plurality of substances 442, 444, 446 and 448 are transferred from the intermediate substrate 510 to the substrate 110.

Once the plurality of substances 442, 444, 446 and 448 have been transferred to the substrate 110, the second light subsystem 450 then causes the second photoinitiator in at least one of the plurality of substances 442, 444, 446 and 448 to react by irradiating the at least one of the substances 442, 444, 446 and 448 with light having a wavelength within the range of wavelengths to which the second photoinitiator reacts, with an amount of light effective to achieve a second desired property in that one or more substance 442, 444, 446 and 448.

In various exemplary embodiments of the first through sixth substance ejecting or depositing systems 100–600 according to this invention the at least one substance can include inks.

In various exemplary embodiments, where the substrate 110 is paper, the intermediate substrate 510 onto which the applicator 120 deposits a substance 140 is a smooth substrate. Often, this smooth substrate 510 is an intermediate transfer belt or drum. Using an intermediate transfer belt or drum permits the substance 140 to be irradiated to raise the viscosity of the substance without hardening the substance. The smooth surface permits precisely-defined spots to be formed, which are not possible on other, textured substrates, such as paper. The intermediate transfuse belt or drum can have an anti-stick coating, such as Teflon, silicone oil on Viton, or other suitable coatings. The anti-stick coating facilitates transferring the substance from the intermediate substrate 510 to the substrate 110. Spots or droplets of the substance 140 are immobilized by irradiation, and then brought into contact with the second substrate, such as paper.

In various exemplary embodiments, particularly those used in color printing, the intermediate substrate 510 can be made absorbent with respect to the ranges of wavelengths of light that are employed to cure or chemically alter substances according to the systems and methods of this invention. In embodiments where multiple substances 442, 444, 446 and 448 are deposited on the intermediate substrate 510 and selectively cured, it is important that the light subsystem 430 be able to selectively irradiate the deposited substances 442, 444, 446 and 448. When the light subsystem 130, 150, 430 or 450 emits light onto the one or more substances 140, 442, 444, 446 or 448 on the substrate 110 or 510, light that is reflected by the substrate 110 or 510 can prematurely irradiate adjacent deposits. A light-absorbing intermediate substrate 510, such as a blackened intermediate transfuse belt or drum, prevents this pixel cross talk by absorbing, rather than reflecting, this light. A blackened surface of the intermediate substrate 510 surface can be achieved by any suitable method, such as conventional black anodization or conventional sputter coating with a material such as black chrome.

While this invention has been described in conjunction with the specific embodiments above, it is evident that many alternatives, combinations, modifications, and variations are apparent to those skilled in the art. Accordingly, the preferred embodiments of this invention, as set forth above are intended to be illustrative, and not limiting. Various changes can be made without departing from the spirit and scope of this invention.

What is claimed is:

1. A method for ejecting or depositing substances, comprising:

depositing at least one substance on a substrate, the at least one substance comprising at least a first UV-sensitive photoinitiator that reacts upon exposure to a first range of wavelengths of light and a second UV-sensitive photoinitiator that reacts upon exposure to a second range of wavelengths of light that is distinct from the first range of wavelengths;

irradiating the at least one substance with light in the first range of wavelengths to cause the first UV-sensitive photoinitiator to react; and subsequently irradiating the at least one substance with an amount of light in the second range of wavelengths to cause the second UV-sensitive photoinitiator to react.

2. The method of claim 1, wherein:

irradiating the at least one substance with light in the first range of wavelengths comprises irradiating the at least one substance with an amount of light in the first range of wavelengths that is effective to cause substantially all of the first UV-sensitive photoinitiator to react; and irradiating the at least one substance with light in the second range of wavelengths comprises irradiating the at least one substance with an amount of light in the second range of wavelengths that is effective to cause substantially all of the second UV-sensitive photoinitiator to react.

3. The method of claim 1, wherein the first UV-sensitive photoinitiator is a first ultraviolet photosensitive resin and the second UV-sensitive photoinitiator is a second ultraviolet photosensitive resin.

4. The method of claim 1, wherein:

irradiating the at least one substance comprises irradiating the at least one substance with light in the first range of wavelengths to cause the first UV-sensitive photoinitiator to react to achieve a first viscosity in the at least one substance; and subsequently irradiating the at least one substance comprises subsequently irradiating the at least one substance with an amount of light in the second range of wavelengths to cause the second UV-sensitive photoinitiator to react to achieve a second viscosity in the at least one substance.

5. The method of claim 1, wherein:

irradiating the at least one substance comprises irradiating the at least one substance with light in the first range of wavelengths to cause the first UV-sensitive photoinitiator to react to achieve a first property in the at least one substance; and subsequently irradiating the at least one substance comprises subsequently irradiating the at least one substance with an amount of light in the second range of wavelengths to cause the second UV-sensitive photoinitiator to react to achieve a second property, different from said first property in the at least one substance.

6. The method of claim 1, wherein the at least one substance is ink.

7. The method of claim 1, wherein the substrate is paper.

8. The method of claim 1, wherein:

depositing the at least one substance comprises depositing a plurality of substances, each substance comprising first and second UV-sensitive photoinitiators that react upon exposure to first and second ranges of wavelengths of light;

irradiating the plurality of substances comprises irradiating the plurality of substances with light in at least one of the first ranges of wavelengths to cause at least one of the first UV-sensitive photoinitiators in at least one of the plurality of substances to react; and subsequently irradiating the plurality of substances comprises irradiating the plurality of substances with light in at least one of the second ranges of wavelengths to cause at least one of the second UV-sensitive photoinitiators in at least one of the plurality of substances to react.

9. The method of claim 8, wherein:

depositing the plurality of substances comprises separately depositing at least a first substance and a second substance; and irradiating the plurality of substances comprises irradiating the first substance prior to depositing the second substance.

10. The method of claim 8, wherein each of the plurality of substances comprises first and second UV-sensitive photoinitiators that react upon exposure to first and second ranges of wavelengths of light, the first and second wavelengths being different for each of the plurality of substances.

11. The method of claim 8, wherein irradiating the plurality of substances comprises irradiating the plurality of substances with light in at least one of the first ranges of wavelengths to cause substantially all of at least one of the first UV-sensitive photoinitiators in at least one of the plurality of substances to react.

12. The method of claim 8, wherein subsequently irradiating the plurality of substances comprises irradiating the plurality of substances with light in at least one of the second ranges of wavelengths to cause substantially all of at least one of the second UV-sensitive photoinitiators in at least one of the plurality of substances to react.

13. The method of claim 8, wherein the first UV-sensitive photoinitiator is a first ultraviolet photosensitive resin and the second UV-sensitive photoinitiator is a second ultraviolet photosensitive resin.

14. The method of claim 8, wherein:

irradiating the plurality of substances with an amount of light in at least one of the first ranges of wavelengths to cause at least one of the first UV-sensitive photoinitiators to achieve a first viscosity in the corresponding one of the plurality of substances; and subsequently irradiating the plurality of substances with an amount of light in at least one of the second ranges of wavelengths to cause at least one of the second UV-sensitive photoinitiators to react to achieve a second viscosity in the corresponding one of the plurality of substances.

15. The method of claim 1, further comprising transferring the at least one substance from the substrate to a second substrate after irradiating the at least one substance with an amount of light in the first range of wavelengths, and before subsequently irradiating the at least one substance with an amount of light in the second range of wavelengths.

16. A method for ejecting or depositing substances, comprising:

depositing at least one substance onto a substrate, the substrate comprising at least a first photoinitiator that reacts upon exposure to a first range of wavelengths of light, the at least one substance combining with the at least a first photoinitiator as the substance is deposited on the substrate; and irradiating the at least one substance with light in the first range of wavelengths effective to cause the first photoinitiator to react.

17. The method of claim 16, wherein irradiating the at least one substance comprises irradiating the at least one substance with light in the first range of wavelengths effective to cause substantially all of the first photoinitiator to react.

18. The method of claim 16, wherein the substrate further comprises a second photoinitiator that reacts upon exposure to a second range of wavelengths of light that is distinct from the first range of wavelengths so that the substance combines with the second photoinitiator as the at least one substance is deposited on the substrate.

19. The method of claim 18, further comprising subsequently irradiating the at least one substance with light in the second range of wavelengths to cause the second photoinitiator to react.

20. The method of claim 19, wherein subsequently irradiating the at least one substance with light in the second range of wavelengths comprises irradiating the at least one substance with light in the second range of wavelengths to cause substantially all of the second photoinitiator to react.

21. The method of claim 16, wherein the substance comprises a second photoinitiator that reacts upon exposure to a second range of wavelengths of light that is distinct from the first range of wavelengths.

22. The method of claim 21, further comprising subsequently irradiating the at least one substance with light in the second range of wavelengths to cause the second photoinitiator to react.

23. The method of claim 22, wherein subsequently irradiating the at least one substance with light in the second range of wavelengths comprises irradiating the at least one substance with light in the second range of wavelengths to cause substantially all of the second photoinitiator to react.

24. A method for ejecting or depositing substances, comprising:

depositing at least one substance onto a substrate;

transferring the substance to a second substrate, the second substrate comprising at least a first photoinitiator that reacts upon exposure to a first range of wavelengths of light, the substance combining with the first photoinitiator as the at least one substance is transferred to the second substrate; and irradiating the at least one substance with light in the first range of wavelengths to cause the first photoinitiator to react.

25. A substance ejecting or depositing system, comprising:

a substrate;

an applicator usable to deposit at least one substance on the substrate, the at least one substance comprising at least a first UV-sensitive photoinitiator that reacts upon exposure to a first range of wavelengths of light and a second UV-sensitive photoinitiator that reacts upon exposure to a second range of wavelengths of light that is distinct from the first range of wavelengths;

at least one light usable to separately irradiate the at least one substance with the range of wavelengths of light specific to each of the first and second UV-sensitive photoinitiators.

26. The substance ejecting or depositing system of claim 25, wherein the at least one light comprises at least one array of lights.

27. The substance ejecting or depositing system of claim 25, wherein the substrate is paper.

28. The substance ejecting or depositing system of claim 25, wherein the substance is ink.

29. The substance ejecting or depositing system of claim 25, wherein the applicator is usable to deposit at least one ink comprising an ultraviolet photosensitive resin.

30. The substance ejecting or depositing system of claim 25, wherein the at least one light is at least one light emitting device.

31. The substance ejecting or depositing system of claim 25, wherein the at least one light comprises a second at least one light, positioned apart from the at least one light and relative to the substrate, usable to irradiate the at least one substance with the range of wavelengths specific to the second UV-sensitive photoinitiator.

32. The substance ejecting or depositing system of claim 25, wherein the at least one light is integrated with the applicator.

33. The substance ejecting or depositing system of claim 25, wherein the applicator is usable to separately deposit a plurality of substances on the substrate, each substance comprising first and second UV-sensitive photoinitiators that react upon exposure to first and second ranges of wavelengths.

34. The substance ejecting or depositing system of claim 33, wherein the first and second ranges of wavelengths are different for each of the plurality of substances.

35. The substance ejecting or depositing system of claim 33, wherein the at least one light is usable to separately irradiate at least one of the plurality of substances with light that is at least one of the first and second ranges of wavelengths of light specific to that substance.

36. A substance ejecting or depositing system, comprising:

a first substrate;

a second substrate;

an applicator usable to deposit at least one substance on the first substrate, the at least one substance comprising at least a first UV-sensitive photoinitiator that reacts upon exposure to a first range of wavelengths of light and a second UV-sensitive photoinitiator that reacts upon exposure to a second range of wavelengths of light that is distinct from the first range of wavelengths of light;

a first at least one light positioned relative to the first substrate and usable to irradiate the at least one substance to react the first UV-sensitive photoinitiator;

wherein the first substrate is positioned to be usable to transfer the at least one substance from the first substrate to the second substrate; and a second at least one light positioned relative to the second substrate and usable to irradiate the at least one substance that has been transferred to the second substrate to react the second UV-sensitive photoinitiator.

37. The substance ejecting or depositing system of claim 36, wherein the at least one substance is ink.

38. The substance ejecting or depositing system of claim 36, wherein the first substrate is an intermediate substrate.

39. The substance ejecting or depositing system of claim 38, wherein the intermediate substrate is an intermediate transfuse belt.

40. The substance ejecting or depositing system of claim 39, wherein the intermediate transfuse belt is blackened.

41. The substance ejecting or depositing system of claim 36, wherein the second substrate is paper.

42. The substance ejecting or depositing system of claim 36, wherein the applicator is usable to separately deposit a plurality of substances on the first substrate, each substance comprising first and second UV-sensitive photoinitiators that react upon exposure to first and second ranges of wavelengths.

43. The substance ejecting or depositing system of claim 42, wherein the first and second wavelengths are different for each of the plurality of substances.

44. The substance ejecting or depositing system of claim 42, wherein the first at least one light is usable to separately irradiate at least one of the plurality of substances with the first range of wavelengths of light specific to that substance, and the second at least one light is usable to separately irradiate at least one of the plurality of substances with the second range of wavelengths of light specific to that substance.

45. The substance ejecting or depositing system of claim 36, wherein at least one of the first and second at least one lights is at least one array of lights.

46. The substance ejecting or depositing system of claim 36, wherein the first at least one light is mounted on the applicator.

* * * * *